US010213024B2

(12) United States Patent
Reinhard

(10) Patent No.: US 10,213,024 B2
(45) **Date of Patent: *Feb. 26, 2019**

(54) OFFICE, WORK AND LEISURE CHAIR AND RETROFIT KIT FOR A CHAIR OR A SEAT SURFACE FOR CAUSING SUBLIMINAL MOVEMENTS OF THE PERSON SITTING THEREON

(71) Applicant: iii solutions GmbH, Baar (CH)

(72) Inventor: Andreas Reinhard, Baar (CH)

(73) Assignee: iii solutions GmbH, Baar (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/499,160

(22) Filed: Apr. 27, 2017

(65) Prior Publication Data

US 2017/0290433 A1 Oct. 12, 2017

Related U.S. Application Data

(63) Continuation of application No. PCT/IB2015/058317, filed on Oct. 28, 2015.

(30) Foreign Application Priority Data

Oct. 28, 2014 (CH) ..... 1657/14

(51) Int. Cl.
*A47C 7/14* (2006.01)
*A47C 9/00* (2006.01)
(Continued)

(52) U.S. Cl.
CPC ..... *A47C 7/14* (2013.01); *A47C 3/22* (2013.01); *A47C 7/025* (2013.01); *A47C 7/34* (2013.01);
(Continued)

(58) Field of Classification Search
CPC .... A47C 7/14; A47C 3/22; A47C 7/34; A47C 7/35; A47C 7/44; A47C 7/462; A47C 9/002; A47C 9/02; A47C 31/008
See application file for complete search history.

(56) References Cited

U.S. PATENT DOCUMENTS 5,588,704 A * 12/1996 Harza ..... A47O 3/0255 297/314
5,590,930 A * 1/1997 Glockl ..... A47O 3/0257 297/258.1
(Continued)

FOREIGN PATENT DOCUMENTS

DE 35 13 985 A1 10/1986
DE 3513985 A1 10/1986
(Continued)

OTHER PUBLICATIONS

International Search Report with translation for PCT/IB2015/058315, dated Feb. 10, 2016.
(Continued)

*Primary Examiner* — Philip F Gabler
(74) *Attorney, Agent, or Firm* — Sughrue Mion, PLLC

(57) ABSTRACT

Office, work and leisure chair and retrofit kit for causing subliminal movements of the person sitting thereon. The chair has a cruciform base (1), freely articulated rollers (4), a gas-spring support (2) and an interface panel (5) resting thereon as a support panel. Mounted on the support panel is a base panel (28) bearing a seat cover (19) with a seat surface and back rest (22). The seat cover is provided and allowed to wobble, resting via a cover panel (27) on a plurality of spring elements (7), which are displaceable radially, or obliquely in relation to the radial direction, or helically from the center of the base panel to the periphery of the base panel. The spring elements are mechanically, hydraulically, pneumatically or electrically displaceable, so that the
(Continued)

wobble distance of the seat cover and the attenuation of the wobble movement are variable.

17 Claims, 11 Drawing Sheets

(51) Int. Cl.

| | |
|---|---|
| ***A47C 3/22*** | (2006.01) |
| ***A47C 7/02*** | (2006.01) |
| ***A47C 7/44*** | (2006.01) |
| ***A47C 7/46*** | (2006.01) |
| ***A47C 9/02*** | (2006.01) |
| ***A47C 31/00*** | (2006.01) |
| ***A47C 31/12*** | (2006.01) |
| ***A47C 7/34*** | (2006.01) |
| ***A47C 7/35*** | (2006.01) |

(52) U.S. Cl.
CPC ..... *A47C 7/35* (2013.01); *A47C 7/44* (2013.01); *A47C 7/462* (2013.01); *A47C 9/002* (2013.01); *A47C 9/02* (2013.01); *A47C 31/008* (2013.01); *A47C 31/126* (2013.01)

(56) References Cited

U.S. PATENT DOCUMENTS

| | | | | |
|---|---|---|---|---|
| 5,769,492 | A * | 6/1998 | Jensen | A47O 9/002 297/188.09 |
| 5,976,097 | A * | 11/1999 | Jensen | A47O 7/024 297/330 |
| 6,413,194 | B1 | 7/2002 | Gant | |
| 7,093,900 | B1 * | 8/2006 | Schon | A47O 9/002 297/259.4 |
| 9,016,786 | B2 * | 4/2015 | Glockl | A47O 3/22 297/313 |
| 9,289,067 | B2 * | 3/2016 | Meyer | A47O 7/14 |
| 2008/0079301 | A1 * | 4/2008 | Schaaf | A47O 7/14 297/313 |
| 2017/0290432 | A1 * | 10/2017 | Reinhard | A47O 7/14 |

FOREIGN PATENT DOCUMENTS

| | | | |
|---|---|---|---|
| DE | 299 00 747 | U1 | 4/1999 |
| DE | 10 2005 033 052 | A1 | 2/2007 |
| DE | 102005033052 | A1 | 2/2007 |
| FR | 1305406 | A | 5/1961 |
| FR | 1 305 406 | A | 10/1962 |
| WO | 2007/105960 | A1 | 9/2007 |
| WO | WO2007105960 | | 9/2007 |

OTHER PUBLICATIONS

International Preliminary Report on Patentability with translation for PCT/IB2015/058315, dated May 2, 2017.
International Search Report with translation for PCT/IB2015/058317, dated Feb. 24, 2016.
International Preliminary Report on Patentability with translation for PCT/IB2015/058317, dated May 2, 2017.

* cited by examiner

OFFICE, WORK AND LEISURE CHAIR AND RETROFIT KIT FOR A CHAIR OR A SEAT SURFACE FOR CAUSING SUBLIMINAL MOVEMENTS OF THE PERSON SITTING THEREON

The present invention relates to an office, work or leisure chair which provides substantially improved sitting comfort, more particularly during longer periods of sitting, in that by means of a functional and user-defined, pneumatically-activated mechanism it causes subliminal movements of the person sitting thereon. The invention also relates to a retrofit kit for fitting to an existing chair or any seat surface or area in order to produce subliminal movements of the person sitting thereon.

In view of the fact that for a person, namely a working person, sitting is a relatively recent phenomenon and in principle only became widespread with the growth of a service-provision society and the introduction of computers, sitting as body posture is of increasing importance and, through the very large number of people who nowadays spend their working day sitting down has a corresponding effect on public health. In Germany for the population of approximately 80 million there are a total of 4 billion chairs, i.e. approximately 50 chairs for each person. The chair as a product is therefore an important object that is familiar to everyone, and simply through its extremely extensive use it should offer maximum comfort and support of a person's well-being and physical health.

A scientific study published in the *American Journal of Physiology* of the University of Tel Aviv shows that the human body increasingly and more quickly builds up fat at points which are regularly subjected to pressure and/or tension. In the laboratory tests adipocytes (fat cells) were specifically exposed to mechanical strain in order to simulate sitting for a long time. By means of high-tech microscopy it was investigated how the adipocytes change with the mechanical pressure. The lipid droplets clumped together, became larger and stiffened. From this it can be concluded that during long periods of sitting the static pressure promotes fat accumulation on the buttocks and upper legs. In contrast to this, the adipocytes could be reduced in size through cyclic stretching.

The prior art includes a large number of chair, and, more particularly, office, work and leisure chair designs which all endeavour to optimise sitting comfort and at the same time allow healthy sitting. The typical office, work and leisure chair has as a cruciform base a base pedestal with several legs radially projecting in a star-like manner from the support or a horizontal ring on which rollers rotating about an additional vertical axle are arranged so that in principle the chair can be rolled in all directions. The typical office, working and leisure chair also has a stable seat surface which is borne on the base pedestal in rotatable manner around a vertical axis and is height-adjustable, but is stationary in itself. The buttocks and the back of the sitting person are hardly moved on such a chair, which is detrimental to blood circulation and last but not least also on health. Office chairs are also provided with back rests and often also with arm rests. The operating elements for adjusting the seat height, the steepness of the back rest, the height of the arm rests etc. are usually all located under the seat surface and the corresponding levers are not visible when sitting on the chair.

An ergonomic office, working and leisure chair model is disclosed in DE 10 2005 033 052 A1 for example. It shows a piece of furniture for sitting, the seat surface of which lies on a tilting device. Assigned to this tilting device is a stop device in the form of an annular tube air cushion so that via the air cushion the tilt angle of the tilting movements can be adjusted. One possible embodiment relates to several air cushions which can be individually pumped up for the purpose of limiting of deactivating the tilting movement. By way of a manual lever arranged underneath the seat surface the sitting person can inflate the air cushion via an air pump, or allow the air contained therein to also escape underneath the seat surface through a venting valve.

Something similar is also known from a therapeutic seat device in US 2008/0079301 A1. This shows a device for increasing the perception of body movements as well as health, more particularly for persons with neuromuscular conditions, such cerebral palsy or scoliosis. The method of the system is designed in a similar manner to that in [0005] with a supporting structure, a movement controlling unit and a seat substrate. The structure of the device results in two axes standing vertically on each other about which the seat substrate is rotatably borne. In order to dampen these movements, a device for attenuation is provided which comprises an annular, inflatable element. The volume of air contained therein can be regulated by a pump and a venting valve below the seat. However, this device has a very complex structure with a number of individual components for bringing about variably attenuated tilting movements of the person sitting on the chair.

In addition, a device is known from WO 2007/105960 A1 which discloses a sitting device with a centrally-borne seat substrate. Underneath this seat cover are either two or four air cushions which are arranged opposite each other or orthogonally around the central bearing and are connected to each other in such a way that air can be interchanged between them for definable adjustment of the attenuation along the axes of rotation.

The aforementioned documents essentially form the prior art in relation to bringing about movability while sitting. In summary, on such a seating device a person can carry out tilting movements which are superimposed about two axes and can be attenuated via air cushions. The person in question can manually regulate the air volume or pressure by a pump and valve, which can be operated under the seat cover. In actual fact, however, these solutions do not result in a satisfactory sitting posture. Numerous studies confirm that people who sit over a longer period of time are very sluggish and hardly change their sitting position. Indeed, such a person will adjust the degree of attenuation of the air cushion disclosed in the above document only once and become accustomed to the corresponding degree of tilting. Just a short time after the person has sat on the chair, his/her movement activity will decrease considerably or even cease entirely. The body seeks to avoid the tilting movements naturally without the sitting person being directly aware of this. It is the natural sluggishness of a human that inhibits him/her from making unnecessary movements. Furthermore a person employed in an office who works on his/her office, work and leisure chair all day is hardly likely to make systematic adjustments thereto. Once he or she is sitting in a position he/she finds comfortable, he/she will not risk changing this position in a more uncomfortable setting. Additionally, such an idea would not even come into his/her head while he/she is working. Even the greatest variety of variably fine adjustments will not prevent this inaction, as the initiative is inevitably lacking.

The object of the present invention is therefore to provide an office, working and leisure chair to stimulate subliminal movements which treads new paths in achieving the goal, in particular of mechanical and biological stimulation for long-term healthy sitting. The chair is to bring sitting to an entire new level, departing from inactive sitting in the direction of necessarily dynamic, stimulating sitting that also promotes the circulation in the blood vessels of the buttocks, the back and upper legs. The inactivity of the pelvic region caused by the currently available office chair is to be replaced by a natural and necessarily or inevitably brought about pelvis movement for keeping all the muscles in the gluteal and pelvic area, and indirectly also in the back, active. This pelvis movement results in a coupled motion of the spine in that torsion and bending force act thereon, especially in the lumbar region.

By way of adaptive, load-dependent kinematics, the office, work and leisure chair should necessarily induce the subliminal movements so that the sitting person mostly or optionally does not consciously feel them and his/her concentration is not reduced. The person will therefore inevitably constantly perform subliminal movements. Through the unavoidably subliminally active sitting the working concentration should be increased by more than average. The induction of these subtle movements should therefore be assured by reliable means which do not fail in view of the person's work performance or other mental strain. The above aims should thereby be constantly and durably assured.

Optionally the office, work and leisure chair should match an individualisable user profile, the adjustment possibilities of which can actually and regularly be used. The office, work and leisure chair should be an indirectly active chair and not a stationary entity, but nevertheless it should in individual embodiments be largely complete, autonomous of artificial sources of energy and there be usable everywhere.

This problem is solved by an office, work and leisure chair for causing subliminal movement of the person sitting thereon, with a cruciform base and freely articulated rollers, a gas-spring support and, resting thereon, an interface panel as a carrier panel and a base plate mounted thereon bearing a seat cover with a seat surface and back rest, characterised in that the seat cover is borne in such a way that it is capable of wobbling in that it rests via a cover panel on a plurality of spring elements, which are each displaceable radially, obliquely in relation to the radial or helically from the centre of the base panel to the periphery of the base panel, said spring elements being mechanically, hydraulically, pneumatically or electrically displaceable in position outwards or inwards, so that the wobble distance of the seat cover and the attenuation of the wobble movement are variable.

Additionally the problem is solved by way of a retrofit kit for mounting or assembly on the seat surface of a conventional chair which cannot wobble or on any seat surface for producing subliminal movements of the person sitting on the retrofit kit, which is characterised in that the retrofit kit has a seat cover borne so that it is capable of wobbling in that this supported on a plurality of spring elements which are each displaceable radially, obliquely in relation to the radial or helically from the centre of the base panel in the direction toward the periphery of the base panel, said spring elements being mechanically, hydraulically, pneumatically or electrically displaceable in position outwards or inwards, so that the wobble distance of the seat cover and the attenuation of the wobble movement is variable.

Other optional embodiments of the office, working and leisure chair and of the retrofit kit bring about other important functions. As examples, embodiments of this chair and the retrofit kit are presented and their functions described and explained.

Here

Figure 1:
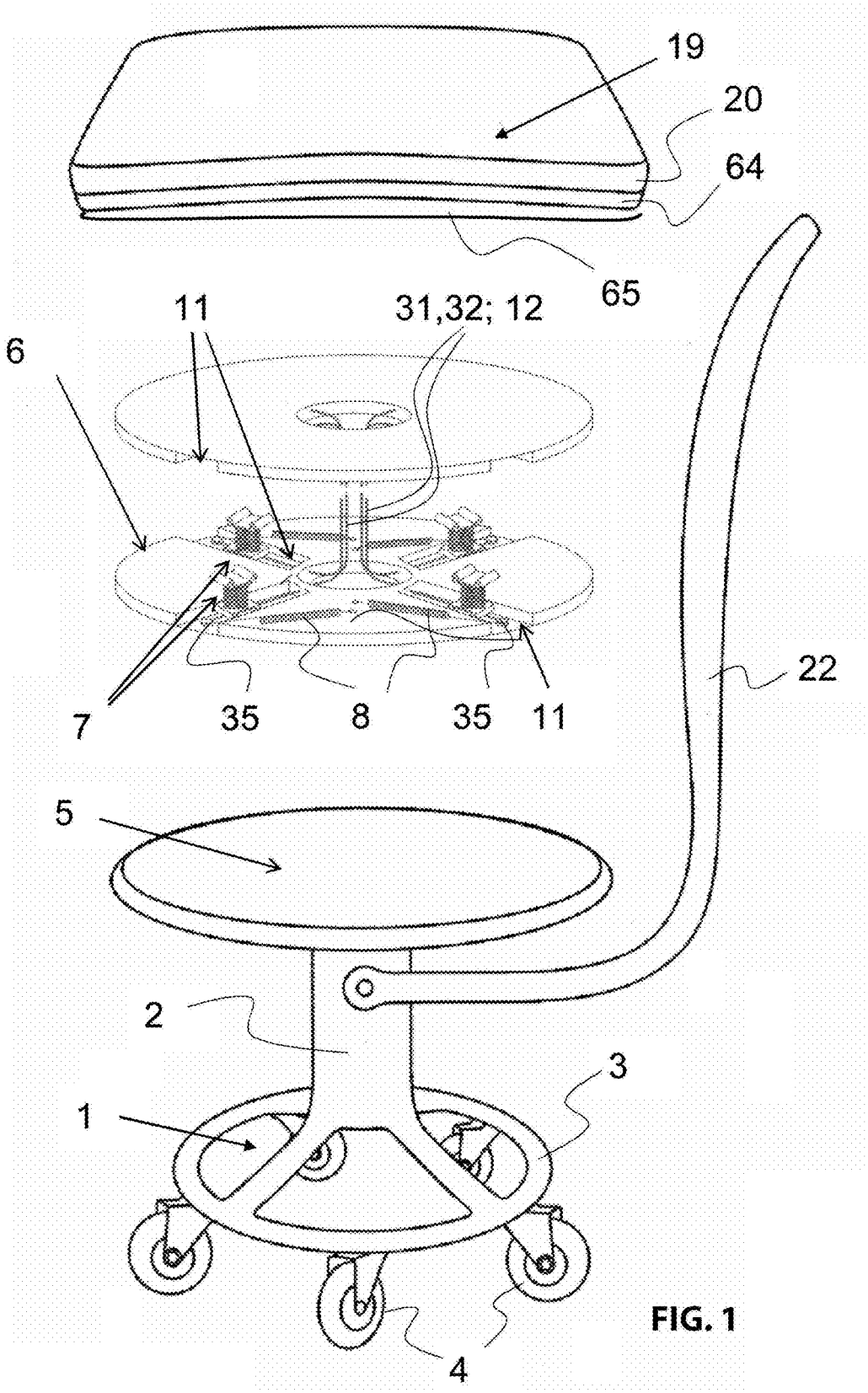
FIG. 1 shows an exploded view of the office, work and leisure chair with a seat surface that can wobble due to movable spring elements, with its essential structural elements.

FIG. 1 shows an exploded view of the structure of this office, work and leisure chair for producing subliminal movements of the sitting person which provides an insight into the essential components. At the bottom a cruciform base 1 can be seen and on top of this a gas-spring support 2, which here is centrally arranged, but can also be laterally displaced, for example right at the back, under the back rest 22 of the office, work and leisure chair in order to keep the area under the seat cover 19 free. With the gas spring the height of the gas spring support 2 is adjustable in the conventional manner. The cruciform base 1 can be in the form of a roller star with five or more arms, on the end of each of which a freely articulated roller 4 is mounted. In the shown example the cruciform base 1 ends in a circumferential ring 3 on which a number of freely articulated rollers 4 are borne. This ensures that the office, work and leisure chair rolls very easily and with minimal resistance in all directions. Arranged at the top of the gas spring support 2 of the cruciform base 1 is an interface panel 5 as a carrier panel for the remaining structure of the chair on which all the components for the wobble action of the seat surface are built up. A chair mechanism can also be arranged on this interface panel 5 so that on the support 2 the interface panel 5 is displaceable forwards and backwards on this chair mechanism. Placed on top of the interface panel 5 is the base panel 28 of a device 6 for bringing about the wobble action.

This device 6 comprises a base panel 28 in which in the shown example of embodiment four radially extending grooves 11 are formed, as well as a cover panel 27 in which such grooves 11 are also provided vis-à-vis the grooves 11 in the base panel 28. These grooves 11 are travel grooves for spring elements 7 which on rollers are displaceable within these grooves 11 inwards, toward the centre of the base panel 28 and cover panel 27 as well as towards the outside. Thanks to these spring elements 7 on the base panel 28 the cover panel 27 can perform a wobbling movement, i.e. tilt in every direction. The displacement or rolling of the spring elements 7 in the grooves 11 takes place by means of a push-pull cable with its two cables 31, 32 which a person sitting on the office, work and leisure chair can operate by means of a lever, an adjusting wheel or a rotating knob on the arm rest. A push-pull cable has the advantage that through pushing or pulling, something at a distance can be operated and also each position can be locked. It is advantageous if this lever is arranged above the seat surface. However, an arrangement under the seat surface is of course also possible. Instead of a push-pull cable with two cables 31, 32 a Bowden cable can be used. Its cable 21 then pulls the spring elements 7 towards the centre, whereas the spring elements 7, by way of tension springs 8 arranged centrally on the base panel 28 are always pulled outwards towards the periphery. The connection cables between the outside of the spring elements 7 and the tension springs pass via one or more deflection rolls 35. The closer the spring elements 7 are to the centre of the base and cover panel, the more easily the cover panel 27 wobbles relative to the base plate 28, and the further towards the periphery they are located the harder it is for it to wobble. In one embodiment in which each spring element 7 is individually displaceable, any of the wobble characteristics can be adjusted so that wobbling toward the back takes place more easily than towards the front etc. As a variant to this adjusting possibility, hydraulic or pneumatic adjustment can also take place. Hydraulic or pneumatic pipelines lead to small cylinder units which displace the spring element though pushing in and retracting the piston. Finally an electronic variant is also implementable wherein the push-pull cables can be operated by push-button operated electric motors. However, for this a battery is required as an energy store.

The seat cover 19, which forms the actual seat cushion, is mounted immovably on the cover panel 27. For this the seat cover 19 or its lower support panel 65 has a recess at the bottom which can be mounted in a precisely fitting manner on the cover panel 27 and can be screwed thereto from underneath. Furthermore the seat cover 19 is constructed in a laminated manner of two or more layers and comprises, from the bottom, a support panel 65 followed by a lower support layer 64 made of a soft elastic material and on which lies an upper support layer 20 which is harder than the lower support layer 64. It can be constructed of even more layers. It is important that in the upward direction a harder layer follows a softer one, even though a softer layer can be present at the very top. In this way, due to the mechanical spring elements 7, in the assembled state of the described elements, the chair with its cover panel 27 and seat cover 19 can wobble, in particular in all directions.

Figure 2:
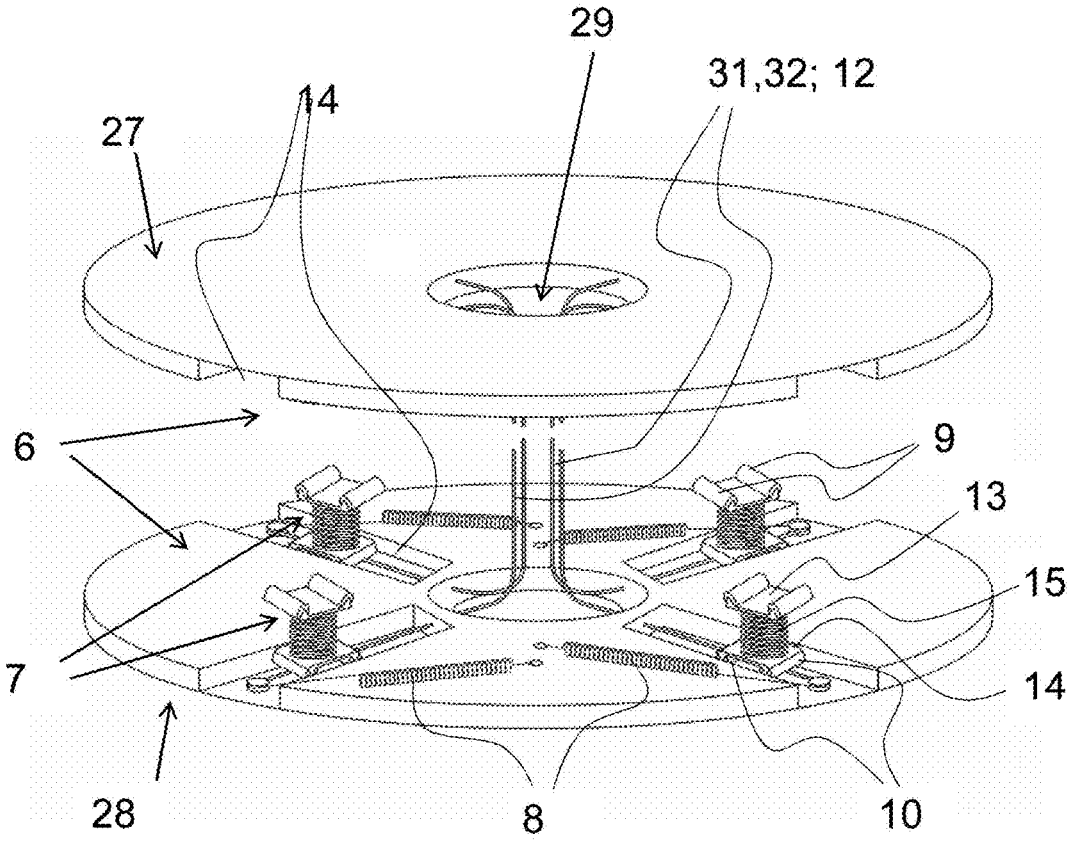
FIG. 2 shows an enlarged view of the mechanical device for ensuring wobbling action of the seat surface.

FIG. 2 shows an enlarged view of the device 6 for bringing about the wobble action. The base panel 28 and cover panel 27 can be seen, each having a hole 29 in the centre through which the push-pull cable 31, 32 or the Bowden cable 12 for displacing the spring elements 7 passes. On the two opposing sides the base panel 28 and cover panel 29 are each provided with four radial grooves 11 which act as travel grooves in which the spring element 7 can be displaced. In this case the spring elements 9 are rolling carriages. The upper panel 13 has two rollers 9 made of steel or hard plastic which project upwards above it and the lower panel 14 has two such rollers 10 which project down beyond it. With these rollers 9, 10 spring elements 7 travel back and forth along the groove, inwards towards the centre of the base panel 28 and cover panel 27, and outwards towards their periphery. It is clear that the grooves 11 can extend in a manner other than radially. They can be oblique to the radial, through which finer adjustability can be achieved as the displacement path is greater. The groove can also extend in a helical manner so that an even longer displacement path is achieved. Each spring element 7 comprises an upper 13 and a lower panel 14. Between these two panels 13, 14 a pressure spring 15 is incorporated in the shown example. This can be linearly or progressively sprung and has a spring path of several centimetres. This spring path can also be selected and the spring elements 7 are interchangeable so that they can be adapted to the weight of a person who is to use the chair. Displacement is preferably activated by means of a push-pull cable 31, 32 which is attached to the front and rear of the carriages so that carriages can be displaced in both directions, or by means of a Bowden cable 12, wherein in each case a tension spring 8 is then necessary which constantly pulls the spring elements 7 outwards, as with a Bowden cable pulling can only take place in one direction, namely towards the centre of the base place 28 and cover panel 27.

Figure 3:
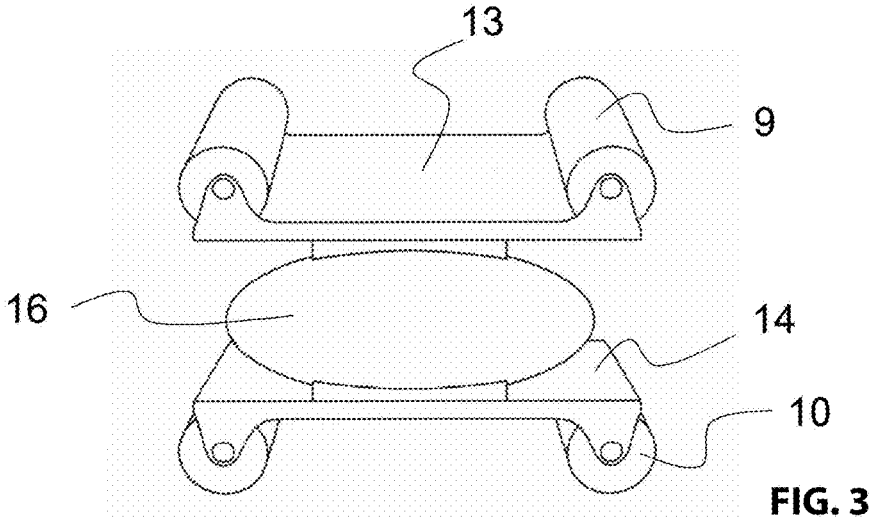
FIG. 3 shows a spring element with rollers at the top and bottom for displaceability and an air bellows in between for suspension.

FIG. 3 shows a single spring element 7 as a carriage with the upper panel 13 with its rollers 9 and the lower panel 14 with its rollers 10. Arranged between them is an air bellows 16 as a pressure spring. Such an air bellows 16 works progressively by itself, that is to say the more it is pressed together the more force or weight is required to press it further together.

Figure 4:
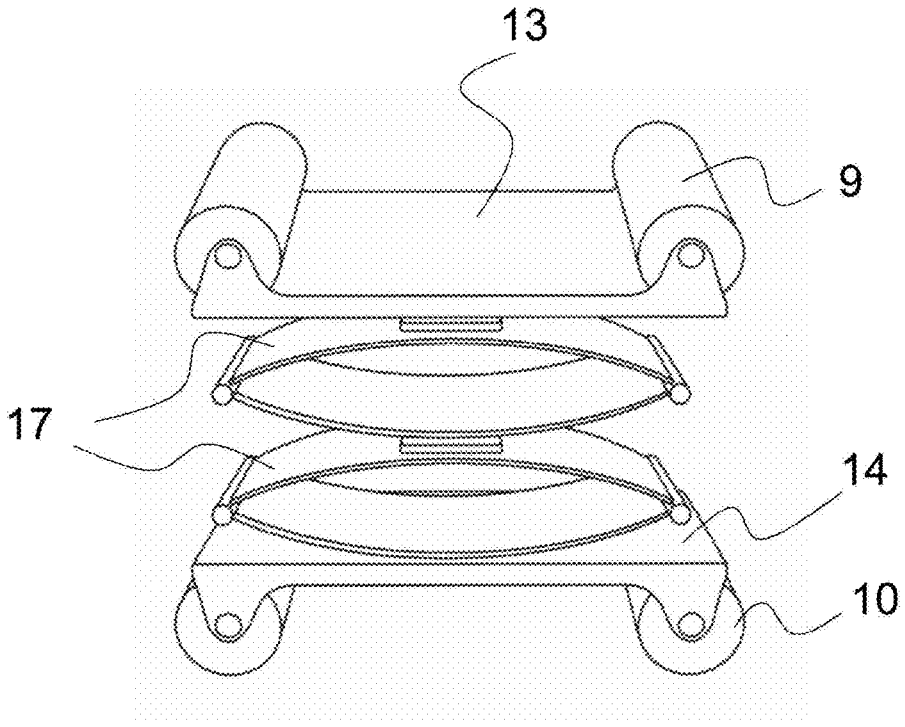
FIG. 4 shows a spring element with rollers at the top and bottom for displaceability and leaf spring packages for suspension.

FIG. 4 shows another example of a single spring element 7 in the form of a carriage with the upper panel 13 with its rollers 9 and the lower panel 14 with its rollers 10. Incorporated between them are two leaf spring packages 17 as suspension. The characteristics of this spring element 7 can be simply changed through incorporating one or more additional leaf spring packages, or such with a different spring force. In this way the wobble characteristics of the cover panel 27 on the base panel 28 can be simply changed. In a further variant the spring elements 7 can be designed as sliding bodies instead of carriages, which are borne on slide rails in these grooves 11 and therefore in a displaceable manner in the grooves 11.

Figure 5:
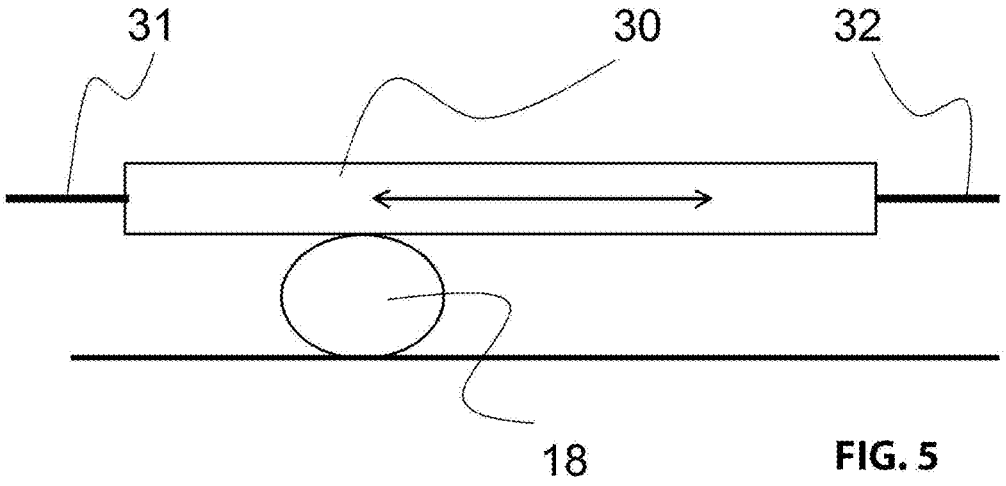
FIG. 5 shows a spring element with a displacement panel which rolls on an elastically sprung elastomer roller as suspension.

FIG. 5 shows a further example of how the adjustable suspension can be brought about. According to this embodiment an elastic elastomer roller 18 rolls in the travel grooves 11. Resting on it is a displaceable panel 30 which at both of its ends, through pulling on cables 31, 32 attached thereon can be displaced in both directions. These cables 31, 32 belong to a push-pull cable, which can be operated by means of a lever on the chair. Here too a Bowden cable can be used as an alternative.

Figure 6:
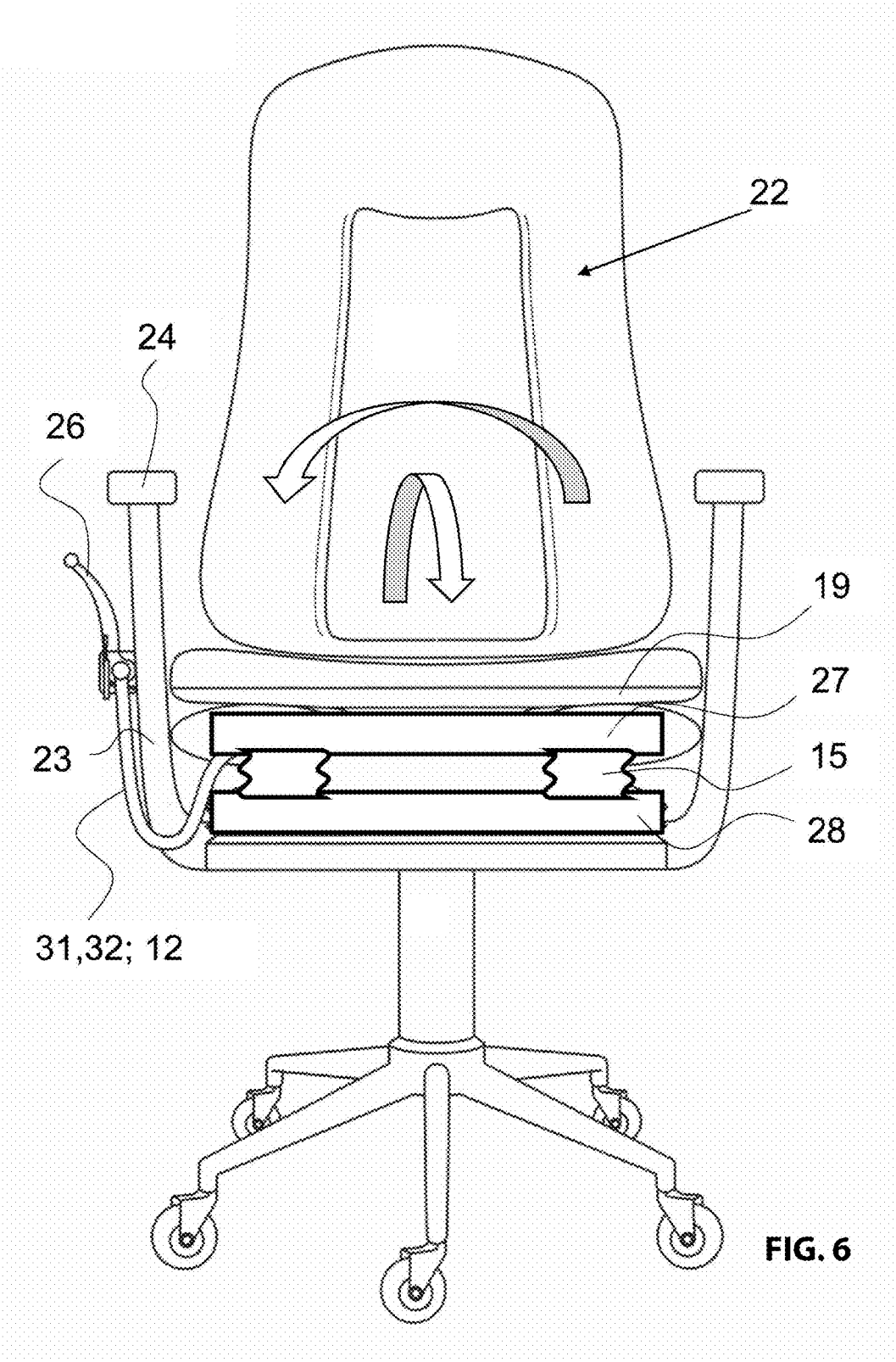
FIG. 6 shows a front view of the office, work and leisure chair with spring elements between a base panel and a cover panel.

FIG. 6 shows an office, work and leisure chair, open at the bottom, so that the base panel 28 and the cover panel 27 can be seen, with the spring elements 7 in between them. The seat cover 19 lies at the top on the cover panel 27. This chair is equipped with arm rests 24 which are arranged on height-adjustable arm supports 23. A lever 26 is arranged on one arm support 23 for operating a push-pull cable with its two cables 31, 32 or a Bowden cable 12. The cables 31, 32; 12 lead to the centre of the base panel 28 and cover panel 27 for the metered displacement of the spring elements 7 between the base panel 28 and cover panel 27 in order to change the wobble characteristics of the seat cover 19.

Figure 7:
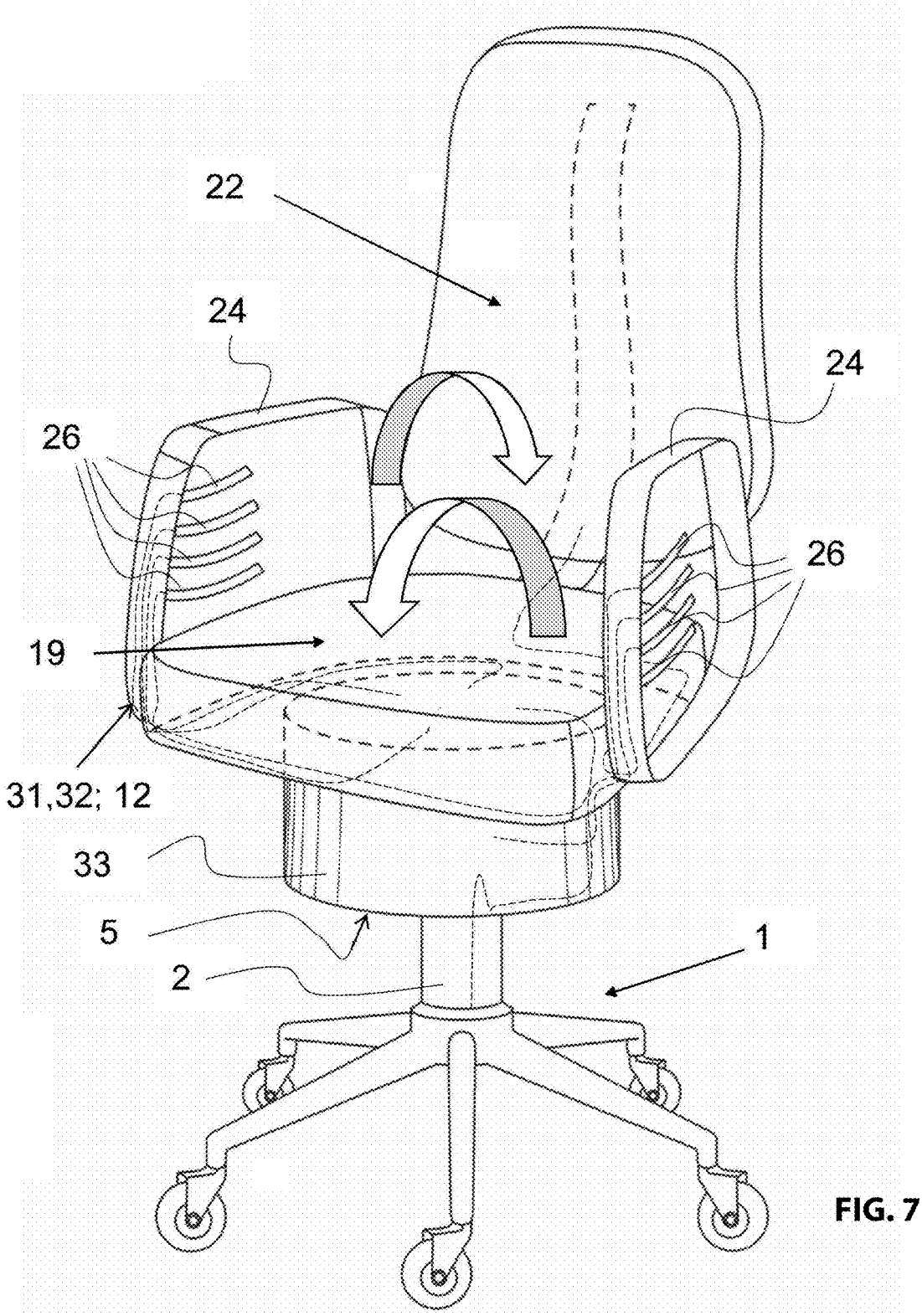
FIG. 7 shows the office, work and leisure chair in the assembled state, together with arm rests and levers for operating the push-pull cables or Bowden cables.

FIG. 7 shows a front view of the assembled office, work and leisure chair with a seat surface 19 capable of wobbling. The cruciform base 1 and the gas spring support 2 can be seen. The entire structure of interface panel 5 including the mechanism for the wobble action is covered by an apron 33 on the office, work and leisure chair, which projects down from the cover panel 27 to a little beyond the interface panel 5. Due to this the entire structure for the wobble action of the seat cover 19 cannot be seen, even in the case of a maximum wobble inclination of the seat surface of seat cover 10. At the back, opposite the back support 22 built onto the gas spring support 2 or the interface panel 5, the apron 33 has a vertical slit if necessary to allow for the passage of the support fastening. The apron 33 can, for example, be in the form of a solid or flexible metal or plastic mantel. It can be covered with a textile material or other suitable material so that it also looks decorative.

On the side of the interface panel 5 or on the support 2, height-adjustable arm supports 24 are attached in a conventional manner. As a special feature several grip levers 26 are arranged on the arm supports 24. These are for adjusting and setting various functions of this special chair. As indicated with the arrows above the seat surface 19 this allows wobble movements in the indicated directions or superimposed in all directions. The wobble capacity, its softness or hardness as well as the wobble paths can be adjusted. This is important simply because of the fact that persons of very different weights must be able to use the chair, ranging from a woman weighing 45 kg to a man weighting a good 150 kg or even more. For a heavy person harder springs are used than for a lighter person. By operating the various push-pull cables or Bowden cables, associated cables 12 or cable pairs which are shown here by dashed lines, can be exposed to tension or pressure and thereby displace the spring elements 7 between the base panel and cover panel, and also allow height adjustment of the support 2 as well as adjustment of the inclination of the back rest 22. The back rest 22 is fastened in a spring-loaded and pivoting manner on the interface panel 5 or on the support 2 in a conventional manner. Overall, with the push-pull cables 31, 32 or the Bowden cables 12 or also with hydraulic, pneumatic or electrical means the following adjustments or settings can be undertaken:

- displacement of the spring elements 7 on the base panel 28, collectively or individually;
- adjustment of the height of the seat surface 19
- adjustment of the inclination of the back rest 22
- adjustment of the seat cover 19 on the interface panel 5 forwards and backwards
- adjustment of the phoronomic elements at the side of the spine support (as will be described below).

Figure 8:
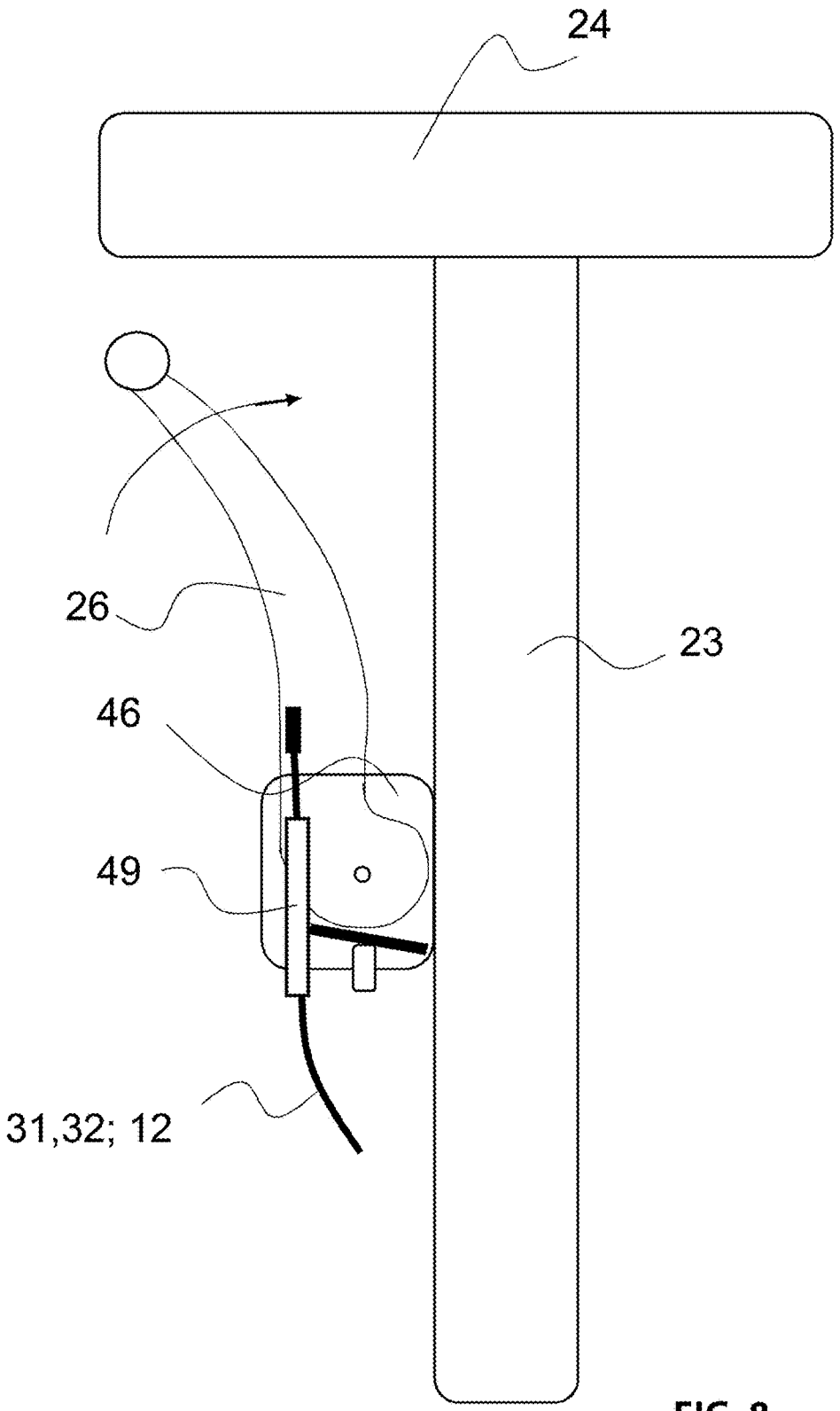
FIG. 8 shows an arm rest with the built-on lever for operating the Bowden cable for operating the pinch valves.

FIG. 8 shows an arm support 24 of the office, working and leisure chair with, attached under the arm support, the lever 26 for operating a push-pull cable or Bowden cable 12 for the displacement of the spring elements 7 between the base and cover panel. Both arm supports 24 each rest on a height adjustable rest support 23 which is attached on the lower structure of the chair or on the interface panel 5. Built onto the rest supports 23 are grip levers 26 as shown in an example, which are similar to a bicycle or motorcycle brake lever. A rotary wheel or knob could be used instead of the lever. On being operated this lever or the rotary wheel or rotary knob pull the cable of the push-pull cable or Bowden cable 12, the cables of which displace the spring elements 7 as has already been described. The grip lever 26 is held in a base 46 in a pivoting manner and this base 46 is connected to the rest support 23. So that the lever movement produces a sufficient adjustment path the cable of the Bowden cable can inversely form a pulley block under the seat cover, or the push-pull cable can be transmitted to achieve a greater path.

Figure 9:
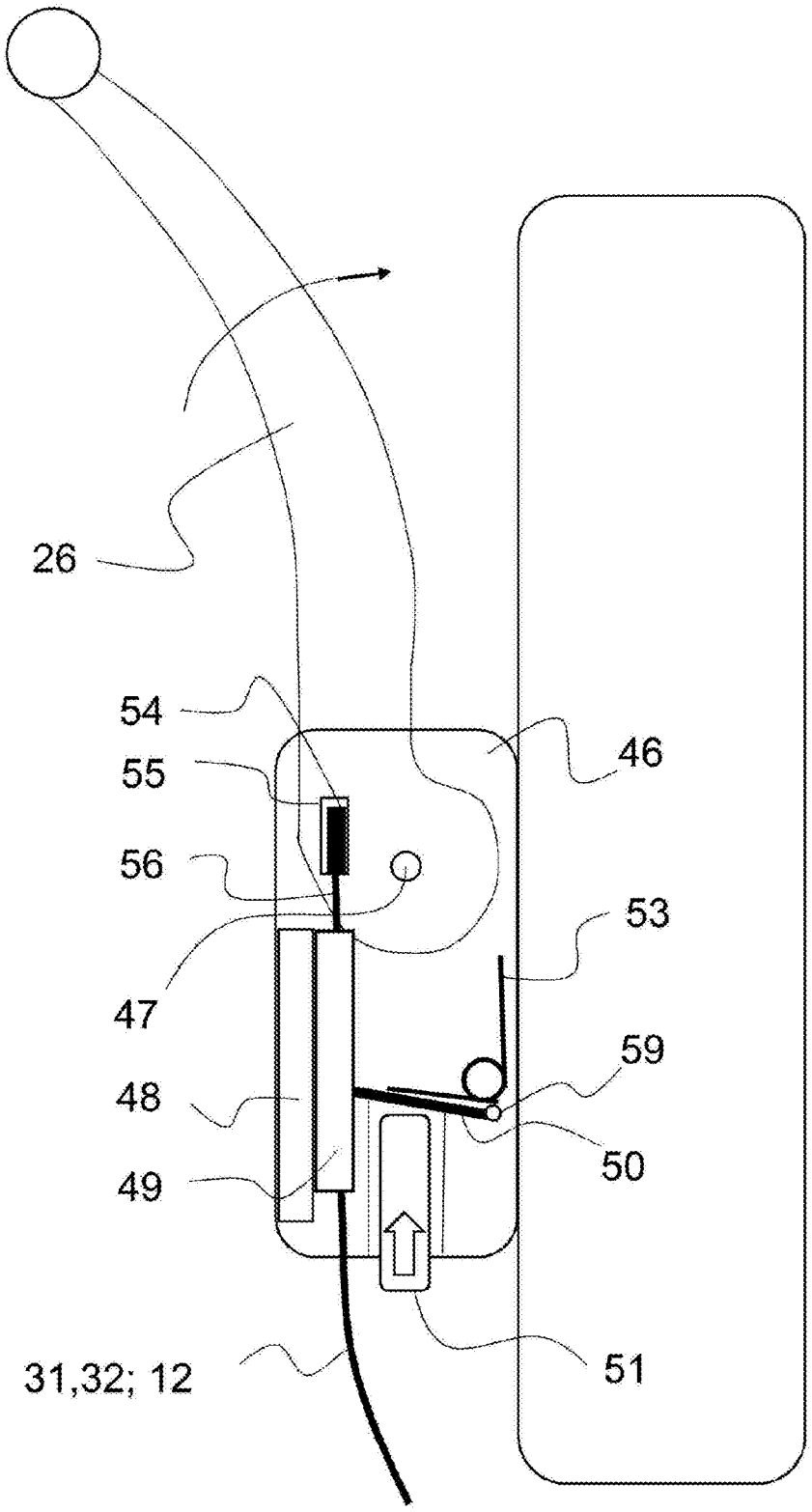
FIG. 9 shows the lever on the arm rest with locking of each position of the Bowden cable by means of spring-loaded clamping plates.

FIG. 9 shows a lever 26 on the arm rest supports 23 with a device for locking the wire cable of the Bowden cable 12 in every position by means of a spring-loaded clamping plate 50 which can be pivoted about a transverse axis 59. In the end area the cable 31, 32; 12 is enclosed in steel cylinder 49 to which it is firmly connected. Its end has a head 54 which sits in a mounting 55 in the grip lever base 46. The grip lever 26 pivots about the axis 47 against the force of a spring 8 which constantly holds the spring element 7 between the base and cover panel tensioned outwards. So that the cable 31, 32; 12 can be locked in every tensile position and thus in every position of the spring elements 9, a pivotable clamping plate 50 acts at a very sharp angle, of slightly less than 90°, on the steel cylinder 49, which on the other side is supported on a support surface 48. The clamping plate 50 is spring loaded by a steel spring 53 and thus constantly turned against the steel cylinder 49. If the grip lever 26 is operated and here turned clockwise, it pulls the cable 31, 32; 12 upwards and the steel cylinder 49 which encompasses the cable 31, 32; 12 is pulled up with it and slides past the front edge of the clamping plate 50. As soon as the grip lever 26 is released the tension spring 8 (FIG. 2) acts such as to pull the cable 31, 32; 12 back down which brings about instant clamping of the steel cylinder 49 with the clamping plate 50. The cable 31, 32; 12 and its steel cylinder 49 can only move downwards if the clamping plate 50 is previously pivoted clockwise upwards against the force of the spring 53 and releases the steel cylinder 49 for displacement. This locking of the clamping plate 50 can be released by pressing from below the pushbutton 51 which is spring loaded by the steel spring 53.

After this office, work and leisure chair and its components have been shown and described, its function and the effect on the person using it are explained below. The height of the office, work and leisure chair and its seat surface can be adjusted in a conventional manner through a height-adjustable support 2 which contains a gas pressure spring for this purpose. However, an important difference consists in the fact that operation takes place by way of a push-pull cable or Bowden cable and the associated lever 26 is attached above the seat surface 19 on an arm rest. This is much more convenient than having to blindly search for a lever under the seat surface by hand. While being seated the height of the chair can be decreased with the lever 26 in that the Bowden cable releases a lock so that the support 2 is telescopically reduced in length against the force of a gas spring. In order to raise the seat surface 19, pressure has to be taken off the seat surface 19 as in conventional height adjustment of office chairs with a gas spring support 2.

The seat surface can wobble in all directions as it rests on the wobble-capable cover panel 27 which in turn rests on spring elements 7 between it and the base panel 28. The closer the spring elements 7 are placed to the periphery of the base and cover panel, the tougher and more restricted the wobble movements are if the person sitting on the chair leans to one side or forwards or backwards. Starting from a hard setting of the wobble capability, the spring elements 7 can be moved closer to the centre. The seat surface 19 can then wobble with a greater angle of inclination and with less force or weight. If the grip lever 26 is operated the push-pull cable or a Bowden cable is activated and the spring elements 7 are displaced inwards or outwards. In an embodiment in which these each have their own push-pull cable or Bowden cable they can be displaced individually. In this way the wobble movement can be adjusted as desired. The seated person will unwittingly keep the seat surface 19 constantly balanced for which his/her pelvic muscles are constantly subliminally active.

Overall this office, working and leisure chair, without active force input by the office, work and leisure chair itself, brings about subliminal, attenuated pelvic movements of the person sitting thereon. These are brought about by way of the adaptive, load-dependent kinematics of the wobble-capable seat surface 19 set out here. As, in principle, the seated person never sits on a completely stationary seat surface, an unnoticeable subliminal movement of his/her pelvis is always taking place. Coupled motions are therefore induced. This activity of the musculature has a lasting positive effect on the entire body and also the mental performance of the seated person.

Figure 10:
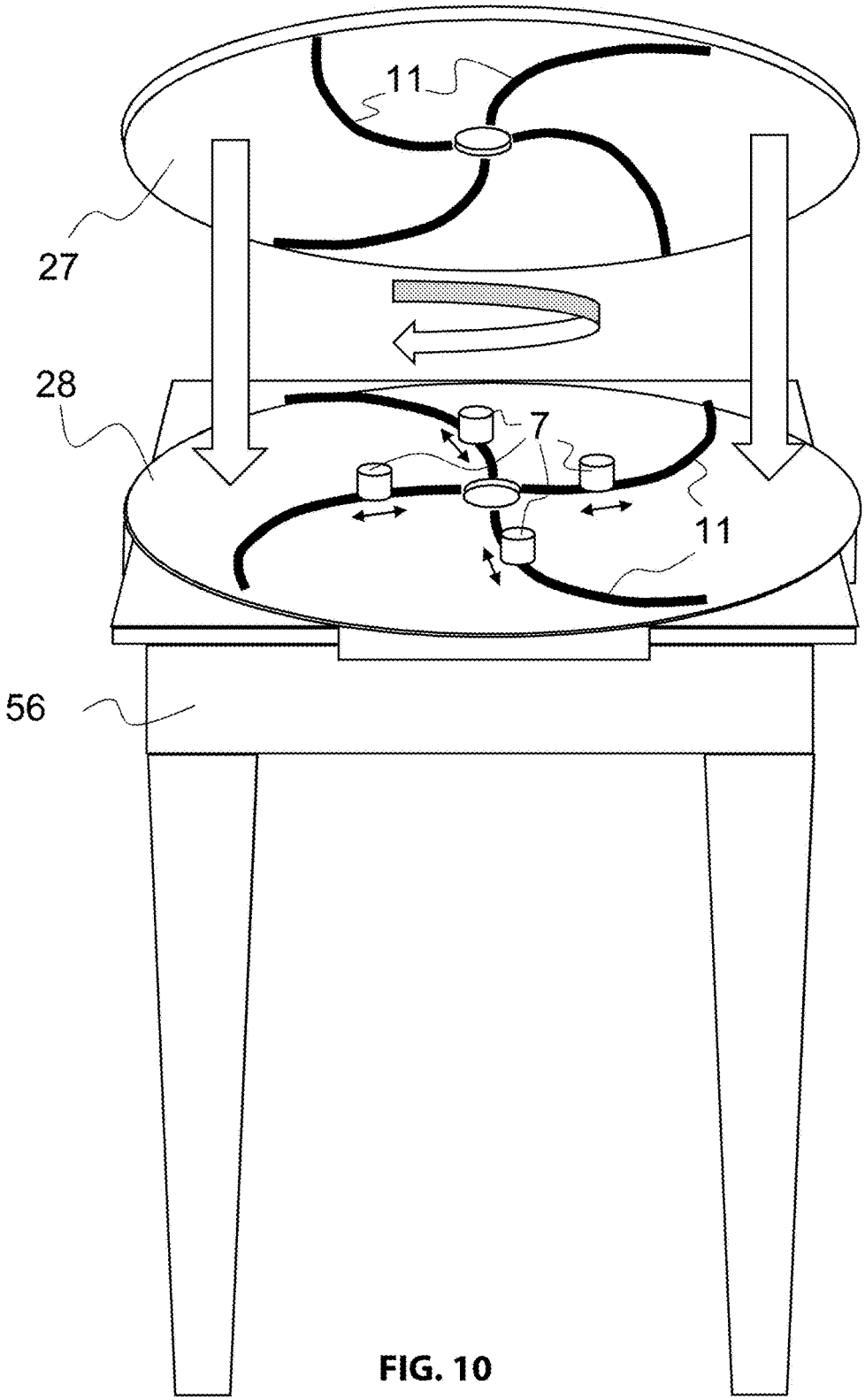
FIG. 10 shows a variant for adjusting the wobble characteristics through turning the seat cover.

In FIG. 10 a further embodiment is shown which can be implemented both on a chair and on a retrofit kit. The upper cover panel 27 can be turned in relation to the lower cover panel 28. The upper end of the spring elements 7 is also turnable relative to the lower end of the spring elements 7. Additionally, the grooves 11, as sliding or travel grooves for the spring elements 7, are designed in such a way that turning of the cover panels 27, 28 relative to each other brings about displacement of the spring elements 7 in the grooves 11. This achieves that the wobble characteristics of the chair can be changed solely by turning the seat surface 19. In all the above-described embodiments with spring elements 7, whether the springs are pressure springs, leaf springs, air bellows or elastically deformable elastomer rollers, the spring elements also allow lateral sprung displacement of the cover panel 27 in relation to the base panel 28. The seat surface 19 can therefore be deflected slightly in a lateral direction, which is intended, and results in further intentional seat dynamics.

In a further embodiment the positions and the height of the spring elements 7, which change as a result of the wobbling action of the seated person, can be recorded by means of sensors and stored in a computer unit. Or, over time the wobble movements can be recorded by means of smart phone software. For this the cover panel 27 or the seat cover 19 is provided with a slit-like garage into which a smart phone can be inserted so that it experiences all the wobble movements and records their magnitudes and directions. The data can then be read out, stored in a computer unit and processed further. They show an individual user profile.

Figure 11:
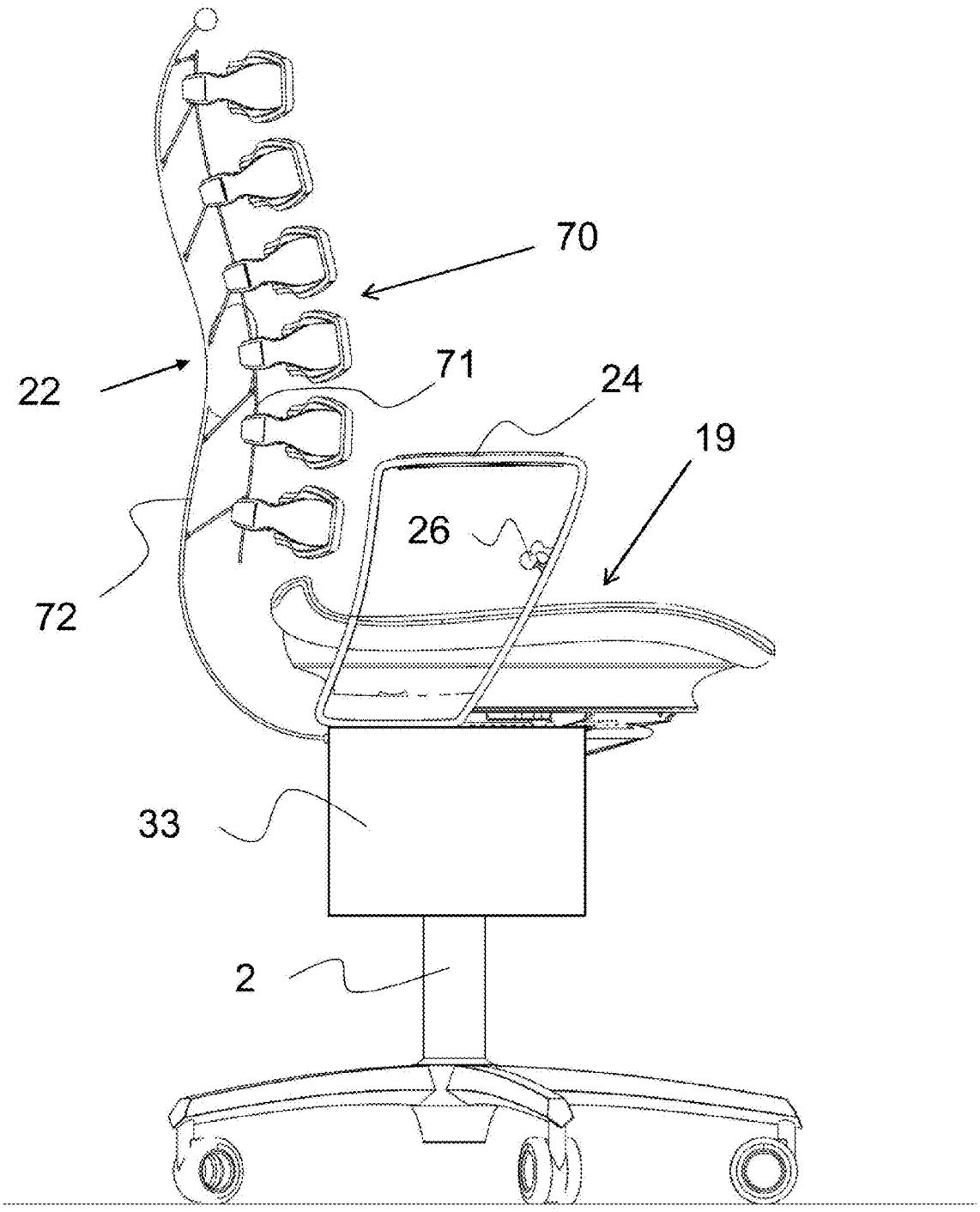
FIG. 11 shows such an office, work and leisure chair with a wobble-capable seat surface in combination with a back rest of phoronomic elements.

Such an office, work and leisure chair with a wobble-capable seat surface can also be equipped with a very special back rest for promoting subliminal movements of the back muscles, as is shown in FIG. 10 in a view from the side. The further special feature of this office, work and leisure chair then also consists in its back rest and its structure of phoronomic elements for the induction of subliminal movements of the back muscles. For this, on such a phoronomic back rest 70 two column strips 71, 72, as a back rest 22 behind the seat surface 19 extend vertically upwards along the spinal column of a person sitting on the seat surface 19 of the chair. Each of these strips is a flat, elastically deformable strip, for example of plastic, wood or a metal sheet. The rear column strip 71 is attached to the interface panel or the support 2 and extends from here with a lateral contour which is modelled on the contour of the buttocks and back of a seated person, initially to the back and then upwards. The inclination of this column strip 72 can be adjusted at its fastening point below the seat surface. As a special feature this office, work and leisure chair shown in FIG. 11, has behind its apron 33 a cover panel under which all the elements for the wobble action of the seat surface 19 rest. In turn the base panel is supported to be displaced backwards and forwards in relation to the office, work and leisure chair on the interface panel, which is mounted on the support 2. For this, sliding or rolling rails are used for example. Displacement can be brought about by means of a push-pull cable or a spring-loaded Bowden cable, wherein the associated operating lever 26 is arranged above the seating surface 19 on an arm rest 24.

Figure 12:
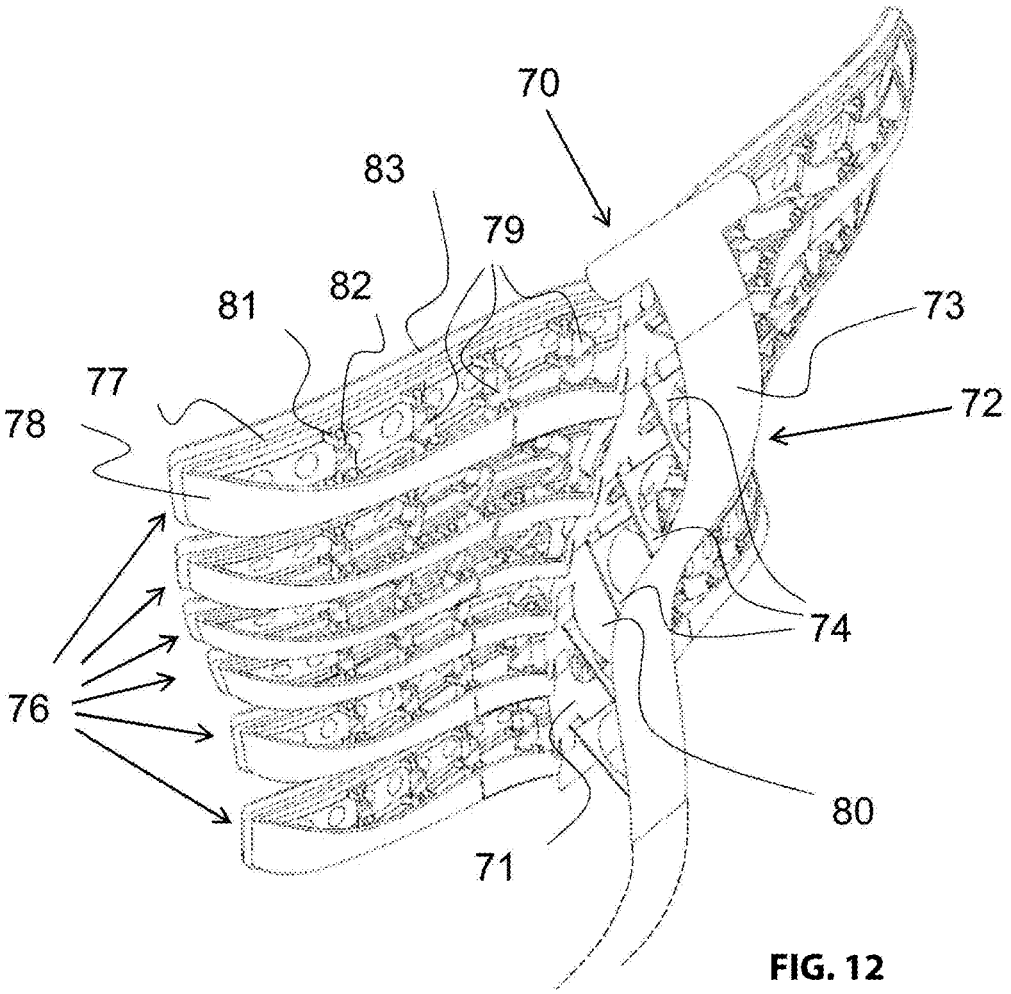
FIG. 12 shows a view from the rear of the back rest and its phoronomic elements

The special design of this phoronomic back rest 70 can be seen in FIG. 12 which discloses a specific embodiment variant in detail. The back rest is shown in a perspective view from diagonally above onto the rear side. A central phoronomic element 70 can be seen which comprises the front column strip 71 and the rear column strip 72, which, however, as indicated at the bottom by the dashed line, continues onwards. These two column strips 71 and 72 are connected to each other by connection struts 74. These connection struts 74 are here made of flat, stiff elements each of which are provided with a central hole to save weight. At both ends these connection struts 74 are connected in an articular manner with the inner side of the front column strip 71 and the rear column strip 72 respectively. Between the column strips 71, 72 an air cushion 80 can be incorporated for attenuating the relative movements of the two column strips 71, 72 toward each other. In his way, on releasing the pressure on the back rest it is returned to its initial state. From the air cushion 80 an air pipe can lead to a connection point which is fitted with a valve, so that by means of a pump it can be inflated to an individually selected pressure and air can be discharged via the valve to individually shape the column strips 71, 72. Several such separate air cushions 80 can of course also be incorporated between the connection struts 74. By varying the length of the connection struts 74, their arrangement and the number and filling pressure of the individual air cushions 80 the contour of the front column strip 71 can be adapted to a particular back contour of a user. Alternatively, between the front column strip 71 and the rear column strip 72 at least one, or also several, steel pressure spring(s) can be built in. It is thus immediately clear that a pressure exerted from the front on the front column strip 71 reduces the distance to the rear column strip 72, and due to the geometry of the arrangement of the connection struts 74 the front column strip 71 moves upwards slightly, i.e. is displaced upwards relative to the rear column strip 72 which is firmly mounted on the chair. On the front column strip 71 phoronomic elements 76 are incorporated which branch off sideway like ribs. These form the actual support surface of the back rest. When the front column strip 71 moves up and down relative to the rear column strip 72 so do the laterally projecting ribs, so that the entire support surface for the back of the person sitting on the chair is slightly moved up and down, and in particular, each time the person newly leans on the back rest this is deflected slightly upwards. The extent of this upward movement depends on the contact pressure and the dimensions and the geometric arrangement of the connection struts 74 between the front column strip 71 and the rear column strip 72. The ribs are also designed as phoronomic elements 76. They are each formed by a front transverse strip 77 and a rear transverse strip 78. These two transverse strips 77, 78 are connected to several connection struts 79. In the shown example these comprise elastically bendable, S-shaped connection struts 79 which at both ends are connected in an articulate manner to the inner side of the transverse strips 77, 78. In this case this is implemented in that at their ends these connection struts 79 have perpendicularly projecting bolts 81 which can be clicked into associated bolt mountings 82. These mountings 82 form two approximately semi-circular bolt mountings and can be elastically spread apart from one another so that the bolts 81 of the connection struts 79 can be clicked into these mountings 82 and can thereafter be pivoted back and forth in the mountings 82. In this way the connection struts 79 can be easily replaced by others. Removal and insertion can take place quickly and without tools.

The articulated connection of the connection struts 74, 79 can at at least one or also at both fastening sides of the struts to the column strip 71, 72 or transverse strip 77, 78 designed to be displaceable in the strip direction. For example, the bolt mountings 82 can be longitudinally displaceable on the inner sides of the transverse strips 77, 78. This displacement can be adjustable by means of push-pull cables or Bowden cables, wherein wires are guided around one or more deflecting rolls in the end regions of the transverse strips 77, 78, and in the case of a Bowden cable are tensioned with a tension spring. By pulling the cables the bolt mountings 82 are also pulled towards the centre of the back rest or pushed outwards. Via deflecting rollers in the interior of the back rest structure the cables lead to an adjusting wheel on an arm rest which can be easily reached from a sitting position and can be brought into different rotary positions and locked in each position.

In order to save weight the front transverse strips 77 are provided with holes here and their fronts are fitted with soft elastic pads 83. If pressure is exerted from the front on the front transverse strips 77, the here S-shaped connection struts 79 are easily elastically deformed and due to their geometry and their arrangement a slight displacement of the front transverse strips 77 relative to the rear transverse strips 78 occurs, wherein for this the rear transverse strips 78, depending on the effect direction of the resulting force, extend a little further or are bent further and the front transverse strip 77 bend forwards or backwards at their ends. Generally the front transverse strips 77 nestle into the contour of the contacting back of the chair user. Through the relative movement of the front transverse strips 77 inwards or outwards induced by the contact pressure the back muscles are also massaged in this direction, even though only very subliminally. Each time the back rest is newly leant on it moves upwards slightly and the perpendicularly projecting transverse strips 77 are each displaced slightly outwards or inwards. Generally low-threshold, indeed subliminal, hardly perceptible but still very effective massaging of the back muscles is achieved which has a positive effect on the remainder of the body.

Figure 13:
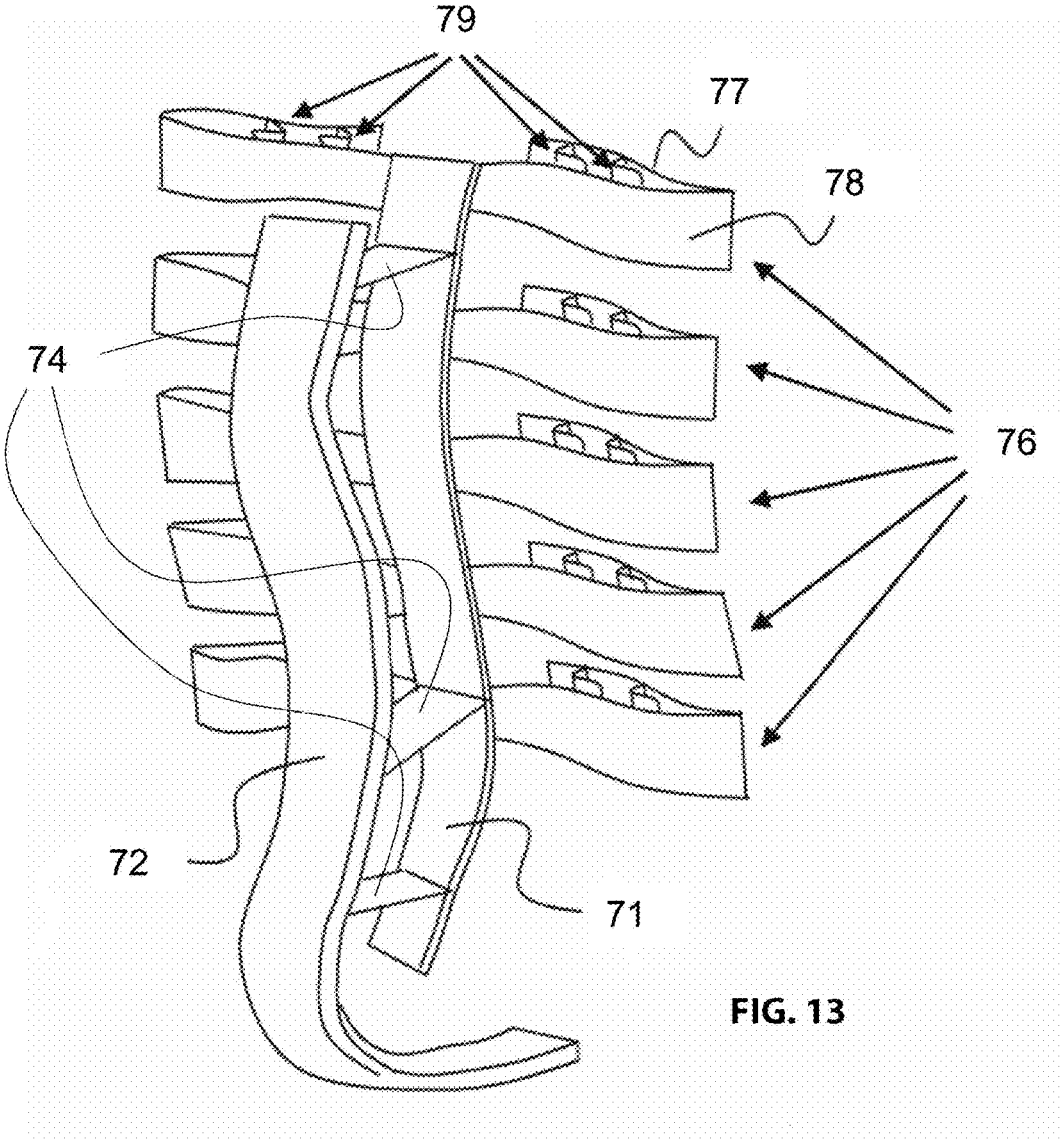
FIG. 13 shows an oblique rear view of a back rest with its phoronomic elements in a particularly simple and effective embodiment.

FIG. 13 shows a particularly advantageous and structurally simple embodiment. The rear column strip 72 is stronger and stiffer in design and is connected via at least three articulated struts 74 with the weaker and more bendable front column strip 71. Attached to this front column strip are the branching off phoronomic elements 76 which in turn each comprise a front transverse strip 77 and a rear transverse strip 78. Incorporated between these are several S-shaped connection struts 79. This back rest design is highly dynamic and extremely comfortable for the chair user leaning against it. During leaning all the elements interact harmoniously and mould to the back muscles while bringing about subliminal movements, wherein the region immediately behind the user's spinal column remains free.

A chair with a wobble-capable seat surface as described in detail above can also be realised by means of a retrofit kit, which can be mounted on any chair. This retrofit kit for mounting on the non-wobble-capable seat surface comprises all the above-described components for the wobble capacity of the seat surface. In contrast to a complete office, work and leisure chair the assembly for the wobble-capacity of the seat surface is in the form of a device 6 for retrofitting, wherein this device 6 has already been described in detail in relation to FIG. 2. The base panel 28 can on its underside comprise a frame running around its edge and projecting downwards, the interior of which is filled with a foam mass, which can be hardened though the supply of warm air, for moulded adaptation to the seat surface contour of the seat surface of a conventional chair to be fitted therewith. This unit 6 can be pulled over the seat surface of an office, work or leisure chair, or also of a simple seat such as a stool. From then on a wobble-capable seat surface is available for active and healthy sitting. As a variant the retrofit kit can be placed on any type of seat, both indoors and outdoors, for example on a wall, a bench or a seat in a sports stadium or in a theatre, cinema or congress hall etc. and a wobble-capable seat surface is instantly available.

The invention claimed is:

1. An office, work and leisure chair for causing subliminal movements of a person sitting thereon with a cruciform base and freely articulated rollers, a gas-spring support and resting thereon an interface panel as a support panel and mounted thereon a base panel bearing a seat cover with a seat surface and back rest, wherein the seat cover is borne in such a way to have wobble capacity as the seat cover rests via a cover panel on a plurality of spring elements, which are displaceable radially, obliquely in relation to the radial direction or helically from the centre of the base panel to a periphery of the base panel, said spring elements being mechanically, hydraulically, pneumatically or electrically displaceable in position outwards or inwards, so that a wobble distance of the seat cover and an attenuation of wobble movement are variable.

2. The office, work and leisure chair according to claim 1, wherein the spring elements are borne in a displaceable manner and each forms a carriage with a lower panel with two rollers projecting downwards and an upper panel with two rollers projecting upwards, wherein a pressure spring is incorporated between the lower and upper panels, and incorporated in the base panel and in the cover plate lying above the base panel are grooves that are travel grooves for the carriages so that the carriages are rollable along the grooves by a push-pull cable or Bowden cable, the operating lever of which is operable when sitting on the office, work or leisure chair.

3. The office, work and leisure chair according to claim 2, wherein the pressure spring is formed by at least one steel pressure spring, at least one air bellows or at least one leaf spring package.

4. The office, work and leisure chair according to claim 1, wherein the base panel is provided with grooves and the spring elements are each formed of at least one elastic elastomer roller each rolling in one of the grooves of the base panel and on which a displacement panel lies, which can be displaced in two directions by a push-pull cable so as to roll on the elastomer roller.

5. The office, work and leisure chair according to claim 1, wherein, in the base panel and the cover plate lying above the base panel, grooves are formed in which sliding elements with built-in pressure springs are displaceably borne on slide rails and are displaceable by at least one push-pull cable or Bowden cable, the operating lever of which can be activated while sitting on the office, work and leisure chair.

6. The office, work and leisure chair according to claim 1, wherein the following elements can be operated by a push-pull cable or a spring-loaded Bowden cable wherein an associated operating lever is arranged above the seat surface on an arm rest or arm rest support:

a. height adjustment of the gas spring support and thus of the seat surface,
b. inclination of the back rest adjustable against a force of a spring,
c. displacement forward and backwards of the base panel on the interface panel or also of the interface panel in relation to the office, work and leisure chair.

7. The office, work and leisure chair according to claim 1, wherein the seat cover or cover panel has a receiving slit for horizontal insertion of a smartphone with an application pertaining to this office, work and leisure chair for recording a sitting behaviour of a person wherein the wobble movements are recordable over time by the smartphone and capable of being evaluated and displayed and wirelessly outputted by the application.

8. The office, work and leisure chair according to claim 1, wherein the seat cover comprises a two or multiple layer, laminate-like layer structure, wherein a lower support layer is of a soft elastic design and an upper support layer is harder, the cover panel is configured to be turned relative to the base panel, an upper end of each spring element is configured to be turned relative to a lower end of the spring element, and a course of grooves that guide displacement of the spring elements is such that the turning of the cover panel relative to the base panel brings about a displacement of the spring element in the grooves so that the wobble characteristics of the chair is changeable solely through turning the seat cover.

9. A retrofit kit for mounting or placing on a non-wobble-capable seat surface of a conventional chair or any seat surface to bring about subliminal movements of a person sitting on the retrofit kit, the retrofit kit comprises a seat cover capable of wobbling and that sits on a cover panel which rests on a plurality of spring elements, each spring element is borne so as to be displaceable radially, obliquely in relation to the radial direction or helically from the centre of an underlying base panel to the periphery of the base panel, said spring elements being mechanically, hydraulically, pneumatically or electrically displaceable in position outwards or inwards, so that a wobble distance of the seat cover and an attenuation of wobble movement can be varied.

10. The retrofit kit according to claim 9, wherein the spring elements are borne in a displaceable manner, wherein each forms a carriage with a lower panel with two rollers projecting downwards and an upper panel with two rollers projecting upwards, wherein a pressure spring is incorporated between the lower and upper panels and incorporated in the base panel, and in the cover plate lying above the base panel are grooves that are travel grooves for the carriages so that the carriages are rollable along the grooves by a push-pull cable or Bowden cable, an operating lever of which is operable when sitting on the office, work or leisure chair.

11. The retrofit kit according to claim 10, wherein the pressure spring is formed by at least one steel pressure spring, at least one air bellows or at least one leaf spring package.

12. The retrofit kit according to claim 9, wherein the base panel is provided with grooves and the spring element is formed of at least one elastic elastomer roller each one rolling in one groove of the base panel and on which a displacement panel lies which is displaceable in two directions by cables of a push-pull cable so as to roll on the elastomer roller.

13. The retrofit kit according to claim 9, wherein in the base panel and the cover panel lying above the base panel are grooves in which sliding elements with built-in pressures springs are borne in a displaceable manner on slide rails and are displaceable by at least one push-pull cable or Bowden cable, an operating lever of which is operable while sitting in the office, work and leisure chair.

14. The retrofit kit according to claim 9, wherein the cover panel is twistable relative to the base panel, an upper end of each spring element is twistable relative to a lower end of the spring element, and a course of the grooves that guide displacement of the spring elements is such that the twisting of the cover panels relative to the base panel brings about a displacement of the spring element in the grooves so that the wobble characteristics of the chair are changeable solely through turning the seat cover.

15. The retrofit kit according to claim 9, wherein an underside of the base panel has a circumferential, downward projecting, apron-like frame, an interior of which is filled with a foam mass, which can be hardened though supply of heat, for moulded adaptation to the seat surface contour of the seat surface of a conventional office, work and leisure chair.

16. The retrofit kit according to claim 9, wherein the seat cover or cover panel has a receiving slit for horizontal insertion of a smartphone with an application pertaining to the retrofit kit for recording sitting behaviour of a person sitting on the retrofit kit wherein the wobble movements is recordable over time by the smartphone and is capable of being evaluated and displayed and wirelessly outputted by the application.

17. The retrofit kit according to claim 9, wherein the seat cover comprises one or a multiple layer, laminate-like, layer structure, a lower support layer of which is of a soft elastic design and an upper support layer is harder.

* * * * *